US008733458B2

(12) United States Patent
Gambier et al.

(10) Patent No.: US 8,733,458 B2
(45) Date of Patent: May 27, 2014

(54) METHOD AND APPARATUS FOR SETTING A PACKER

(75) Inventors: Philippe Gambier, La Defense (FR); Emmanuel Rioufol, Eysines (FR); Ashish Chaudhary, Edmonton (CA); Kellen Devuyst, Edmonton (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 2 days.

(21) Appl. No.: 13/007,732

(22) Filed: Jan. 17, 2011

(65) Prior Publication Data

US 2012/0181050 A1 Jul. 19, 2012

Related U.S. Application Data

(60) Provisional application No. 61/295,930, filed on Jan. 18, 2010.

(51) Int. Cl.
*E21B 33/12* (2006.01)

(52) U.S. Cl.
USPC ..... 166/387; 166/181

(58) Field of Classification Search
USPC ..... 166/250.1, 387, 66, 181
See application file for complete search history.

(56) References Cited

U.S. PATENT DOCUMENTS 5,207,272 A * 5/1993 Pringle et al. ..... 166/66.6
7,458,420 B2 * 12/2008 Rioufol et al. ..... 166/250.01
7,562,712 B2 7/2009 Cho et al.
2002/0062991 A1 * 5/2002 Farrant et al. ..... 175/4.55
2003/0024704 A1 2/2003 Hirsch et al.
2004/0040707 A1 3/2004 Dusterhoft et al.
2005/0087344 A1 4/2005 Toekje et al.

OTHER PUBLICATIONS

International Preliminary Report on Patentability and Written Opinion issued in PCT/US2011/021452 on Jun. 28, 2011, 5 pages.
International Search Report issued in PCT/US2011/021452 on Jun. 28, 2011, 3 pages.

* cited by examiner

*Primary Examiner* — David Bagnell
*Assistant Examiner* — Taras P Bemko
(74) *Attorney, Agent, or Firm* — David J. Groesbeck; Brandon S. Clark

(57) ABSTRACT

A hydraulically set packer assembly actuated over an electronic line. The assembly includes a hydraulic packer setting mechanism that serves as an intensifier that is activated by way of an electronic trigger. As such, the trigger may be electronically coupled to an electronic line that is conventionally available for surface communications between surface equipment and a downhole gauge. The gauge generally present for monitoring well conditions such as pressure. Thus, a separate dedicated hydraulic or other powering line need not be outfitted as part of the assembly. Once more, for sake of gauge and well monitoring integrity, communications with the setting mechanism may be severed upon setting of the packer.

14 Claims, 5 Drawing Sheets

METHOD AND APPARATUS FOR SETTING A PACKER

PRIORITY CLAIM/CROSS REFERENCE TO RELATED APPLICATION(S)

This Patent Document claims priority under 35 U.S.C.§119 to U.S. Provisional App. Ser. No. 61/295,930, filed on Jan. 18, 2010, and entitled, "Method and Apparatus for Setting a Packer", incorporated herein by reference in its entirety.

FIELD

Embodiments described relate to a packer assembly. In particular, equipment and techniques for triggering a hydraulic setting module of the assembly are described. More specifically, electronic equipment and techniques may be utilized for such triggering without reliance on potentially more stressful hydraulic triggering.

BACKGROUND

Exploring, drilling and completing hydrocarbon and other wells are generally complicated, time consuming, and ultimately very expensive endeavors. As a result, over the years, a significant amount of added emphasis has been placed on overall well architecture, monitoring and follow on interventional maintenance. Indeed, perhaps even more emphasis has been directed at minimizing costs associated with applications in furtherance of well construction, monitoring and maintenance. All in all, careful attention to the cost effective and reliable execution of such applications may help maximize production and extend well life. Thus, a substantial return on the investment in the completed well may be better ensured.

In line with the objectives of maximizing cost effectiveness and overall production, the well may be of a fairly sophisticated architecture. For example, the well may be tens of thousands of feet deep, traversing various formation layers, and zonally isolated throughout. That is to say, packers may be intermittently disposed about production tubing which runs through the well so as to isolate various well regions or zones from one another. Thus, production may be extracted from certain zones through the production tubing, but not others. Similarly, production tubing that terminates adjacent a production region is generally anchored or immobilized in place thereat by a mechanical packer, irrespective of any zonal isolation.

A packer, such as the noted mechanical packer, may be secured near the terminal end of the production tubing and equipped with a setting mechanism. The setting mechanism may be configured to drive the packer from a lower profile to a radially enlarged profile. Thus, the tubing may be advanced within the well and into position with the packer in a reduced or lower profile. Subsequently, the packer may be enlarged to secure the tubing in place adjacent the production region.

Once the production tubing is in place, activation of the setting mechanism is generally hydraulically triggered. More specifically, the mechanism is equipped with a trigger that is responsive to a given degree of pressure induced in the well. So, for example, surface equipment and pumps adjacent the well head at surface may be employed to induce between about 3,000 and 4,000 PSI in the well. Depending on the location of the trigger for the setting mechanism, this driving up of pressure may take place through the bore of the production tubing or through the annulus between the tubing and the wall of the well.

Unfortunately, the noted hydraulic manner of driving up pressure for triggering of the setting mechanism may place significant stress on the production tubing. For example, where the hydraulic pressure is induced through the tubing bore, the strain on the tubing may lead to ballooning. Furthermore, the strain on the tubing may have long term effects. That is to say, even long after setting the packer, strain placed on the tubing during the hydraulic setting of the packer may result in failure, for example, during production operations. To avoid such a catastrophic event, whenever pressure tolerances are detectably exceeded, the entire production tubing string and packer assembly may be removed, examined, and another deployment of production equipment undertaken. Ultimately, this may eat up a couple of days' time and upwards of $100,000 in expenses.

In order to avoid the costly scenario of having to remove and re-deploy the entire production string, other manners of packer setting are available. For example, a dedicated hydraulic control line may be run to the setting mechanism from surface. Indeed, this may already be done where the production tubing is open to the well, rendering well hydraulics unavailable for triggering of the mechanism. Regardless, a dedicated hydraulic line to the setting mechanism means that exposure of the production tubing to dramatic pressure increases for packer deployment is eliminated. Thus, the possibility of tubing failure in the future due to prior hydraulic strain is reduced.

Unfortunately, the utilization of a dedicated hydraulic line for the setting mechanism only shifts the concerns over hydraulic deployment from potential production tubing issues to issues with other downhole production equipment. For example, a dedicated hydraulic line is itself an added piece of production equipment. Thus, it comes with its own added expenses and failure modes. Indeed, due to the fact that a new piece of equipment is introduced, the possibility of defective production string equipment is inherently increased even before a setting application is run. Once more, where such defectiveness results in a failure, the same amount of time and expenses may be lost in removal and re-deployment of the production string. Thus, the advantages obtained from protecting the production tubing by utilization of a dedicated hydraulic line for the setting mechanism may be negligible at best.

SUMMARY

A pressure set packer assembly is provided with a packer disposed about a tubular. A pressure gauge is also secured to the tubular and in electrical communication with surface equipment over an electrical line. Further, a packer setting mechanism is coupled to the packer and the line for electrical surface controlled triggering of setting of the packer.

DETAILED DESCRIPTION

Embodiments herein are described with reference to certain electrically triggered packers and setting assemblies. For example, assemblies utilized in conjunction with production tubing are depicted herein. However, a variety of alternate assemblies utilizing packer isolation and/or anchoring may take advantage of electrically triggered setting techniques detailed herein. Indeed, any packer assembly which make use of downhole electrical gauges may be particularly benefitted by electrical trigging equipment and techniques described below.

Figure 1:
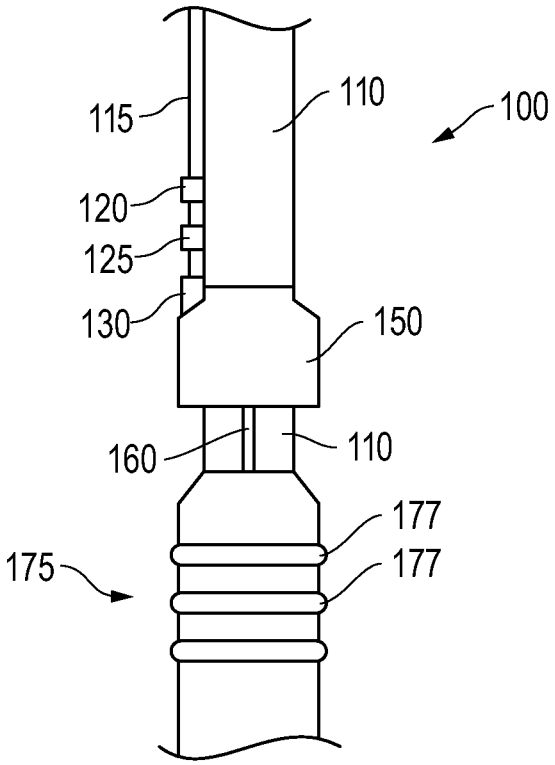
FIG. 1 is a front view of an embodiment of an electrically triggered pressure set packer assembly.

Referring now to FIG. 1, a front view of an embodiment of an electrically triggered pressure set packer assembly 100 is depicted. In the embodiment shown, the assembly 100 is configured for setting of a completions packer 175 with sealing elements 177 near the end of production tubing 110. However, in other embodiments, other types of mechanical packers may be set utilizing such an assembly 100. Also depicted is a hydraulic packer setting mechanism 150, such as a hydrostatic set module (HSM). This mechanism 150 is provided adjacent the packer 175. Thus, a hydraulic line 160 running therebetween may allow for pressure setting of the packer 175 upon triggering of the mechanism 150.

Unlike other conventional hydraulic packer setting mechanisms, the trigger 130 of the mechanism 150 depicted in FIG. 1 is not pressure actuated. Rather, the assembly 100 is outfitted with an electrical line 115. This line 115, generally a tubing encapsulated conductor (TEC) line, is provided to accommodate electrical communications between a gauge 120 such as a pressure monitor and equipment 325 at an oilfield surface 300 (see FIG. 3). However, in embodiments described herein, the trigger 130 is also wired to the line 115 and configured for electrical actuation. In this manner, the trigger 130, and ultimately the setting mechanism 150 may be directed from surface over a line 115 that is already present as part of the assembly 100. As such, the introduction of a hydraulic line running from surface to the trigger 130 may be avoided along with its own failure modes and required care.

Continuing with reference to FIG. 1, a fuse 125 is shown disposed between the trigger 130 and the gauge 120. The fuse 125 is a conventional downhole charge configured to sever communication between the gauge 120 and the setting mechanism 150 or its trigger 130. Thus, following setting of the packer 175, the fuse 125 may be employed to place the gauge 120 substantially in a state of dedicated communication with the oilfield surface 300 and equipment 325. As such, monitoring of downhole pressure, or other well conditions, by the gauge 120 may be largely unaffected over the long term.

Figure 2A:
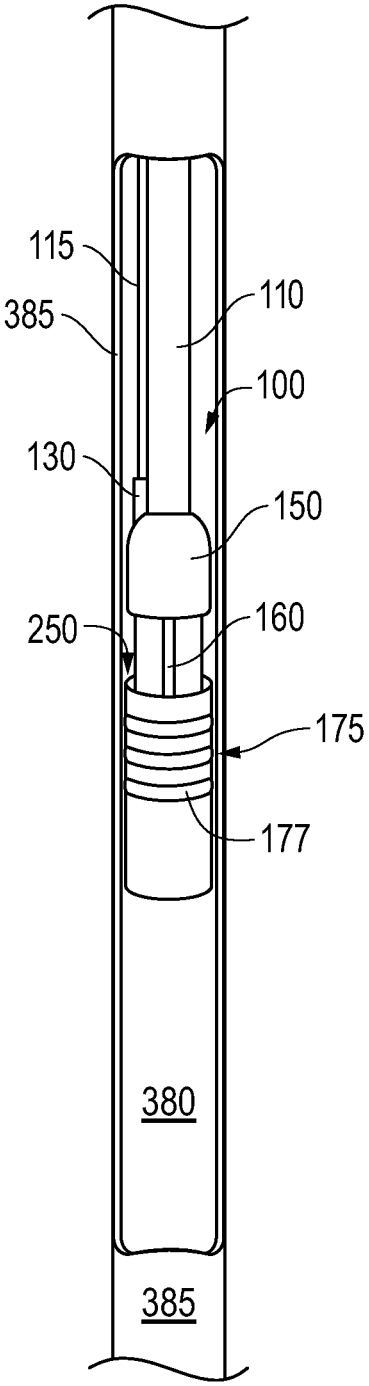
FIG. 2A is a sectional view of a bore casing accommodating the assembly of FIG. 1 in prior to setting a packer thereof.

Referring now to FIG. 2A, a sectional view of a bore casing 385 is shown accommodating the assembly 100 of FIG. 1. More specifically, the assembly 100 has been lowered to a targeted location in the well 380 defined by the casing 385. However, the packer 175 has yet to be set by the setting mechanism 150. This is apparent with reference to the space 250 that is present between the packer 175, more specifically, its sealing elements 177, and the inner wall of the casing 385. Stated another way, an electronic signal has yet to be sent to the trigger 130 over the line 115 to initiate setting of the packer 175 as noted above.

Figure 2B:
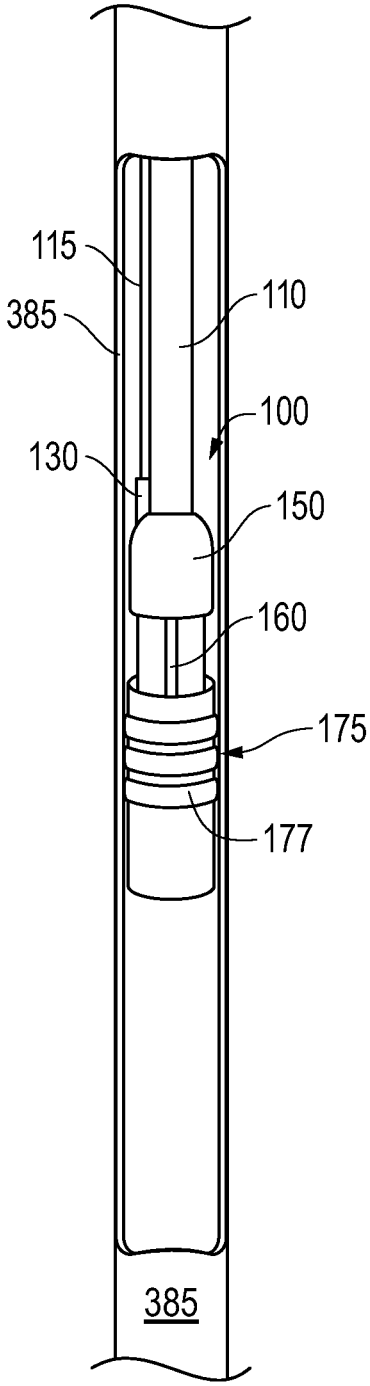
FIG. 2B is a sectional view of the bore casing of FIG. 2A with the assembly therein following the setting of the packer.

With reference to FIG. 2B, a sectional view of the bore casing 385 of FIG. 2A is now shown accommodating the assembly 100 with the packer 175 now set. Namely, via electronic signal to the trigger 130 over the line 115, the setting mechanism 150 is directed to set the packer 175. Indeed, the expansion of the sealing elements 177 is now apparent as the free space 250 of FIG. 2A is no longer present. Additionally, radially expandable slips may also be actuated to ensure anchoring of the sealed engagement between the packer 175 and casing 385.

As noted above, and is apparent from the use of an electrical line 115, the trigger 130 is electrically actuated to initiate the setting depicted in FIG. 2B. More specifically, the trigger 130 may be configured to perforate the setting mechanism 150, or open a port thereof, in order to expose it to well fluid and pressure. This emergence of a flow path and exposure to conventional well pressures serves to initiate setting by the setting mechanism 150.

The setting mechanism 150 may operate as an intensifier as would likely be the case for a conventional packer setting assembly. That is, aside from modifications for accommodating the electronic trigger 130, as described above, the setting mechanism 150 may otherwise be a conventional off-the-shelf hydrostatic set module (HSM), for example. Such a module is detailed in U.S. Pat. No. 7,562,712, Setting Tool for Hydraulically Actuated Devices, to Cho, et al., incorporated herein by reference in its entirety.

Figure 3:
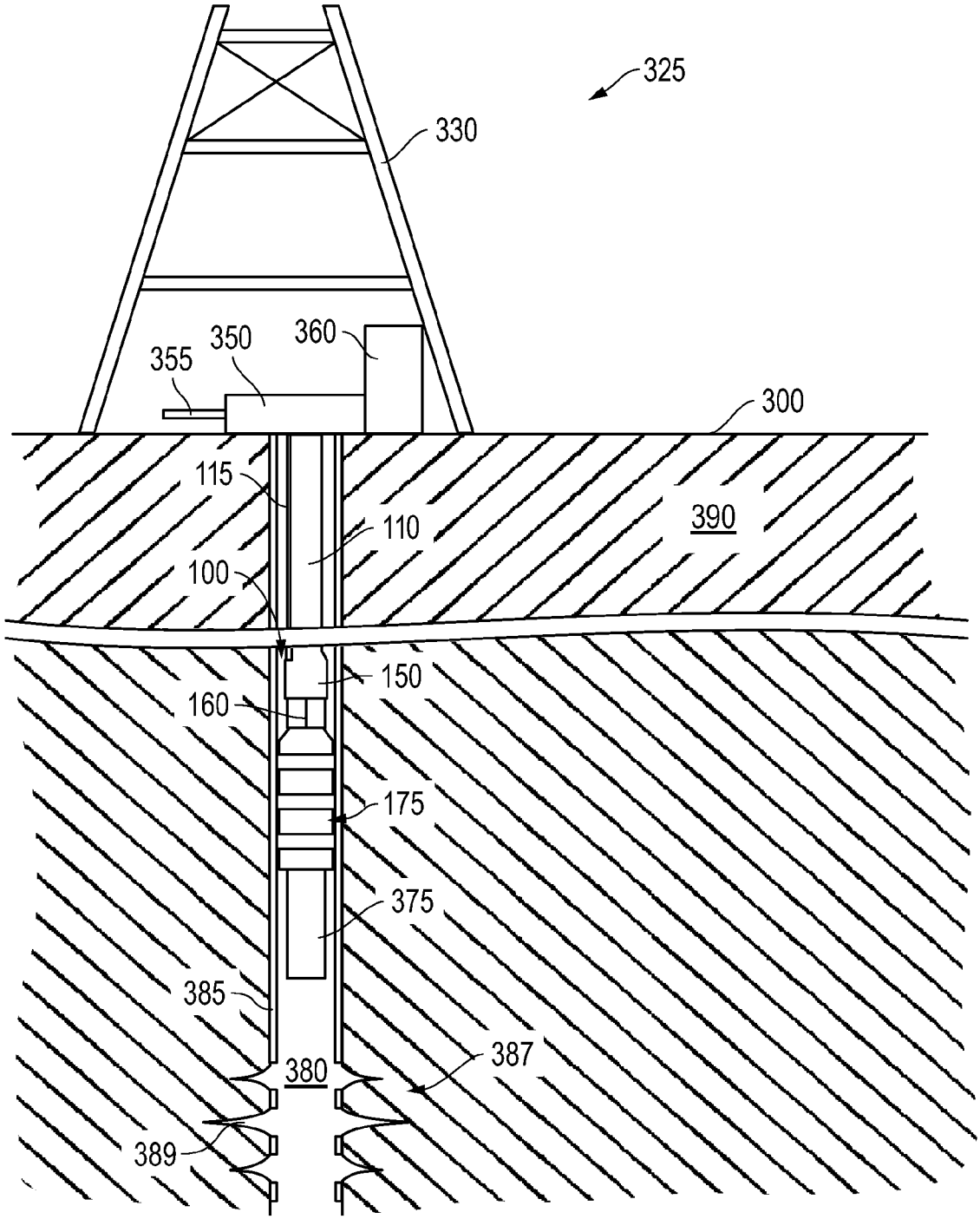
FIG. 3 is an overview of an oilfield with a well accommodating the bore casing and assembly of FIG. 2B therein.

Referring now to FIG. 3, an overview of an oilfield 300 is depicted with a well 380 accommodating the bore casing 385 and assembly 100 of FIG. 2B therein. As shown, the casing 385 and assembly 100 are a part of onshore operations. However, embodiments described herein may also be utilized offshore. In the specific depiction of FIG. 3, the packer 175 can be seen isolating and securing the assembly 100 at a target location that is immediately uphole of a production region 387. That is to say, the well 180 and casing 185 may traverse various formation layers 390. However, production through the production tubing 110 may be controllably limited by the set packer 175 to that emerging from the production region 387. In the embodiment shown, the production region 387 includes perforations 389 through the casing and into the adjacent formation 395. The assembly 100 is even provided with extension tubing 375 bringing it closer to the noted region 375 for hydrocarbon uptake therefrom.

Continuing with reference to FIG. 3, conventional production equipment 325 is located at the oilfield surface 300. Such equipment includes a rig 330 positioned over a well head 350 leading to the well 380, for example, to support well interventions where necessary. Additionally, a production line 355 is shown emanating from the well head 350 for transporting of hydrocarbons recovered from the production region 387 as described above.

A control unit 360 is also located at the oilfield surface 300. Among other things, the unit 360 may be utilized in directing the setting of the packer 175 via the setting mechanism 150 as described above. More specifically, the electrical line 115 detailed above may be run from the unit 360 and into electrical communication with the trigger 130 of the mechanism 150 as described with reference to FIGS. 1, 2A and 2B above. Thus, a line 115 available for other downhole communications and monitoring as noted above, may be utilized for actuation of the packer setting application.

Figure 4C:
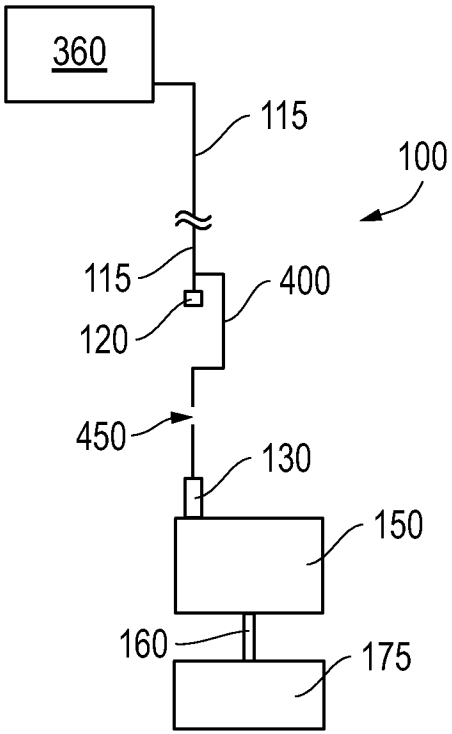
FIG. 4C is a schematic representation of the assembly of FIG. 4B with an electronic triggering line severed following packer setting.
Figure 4B:
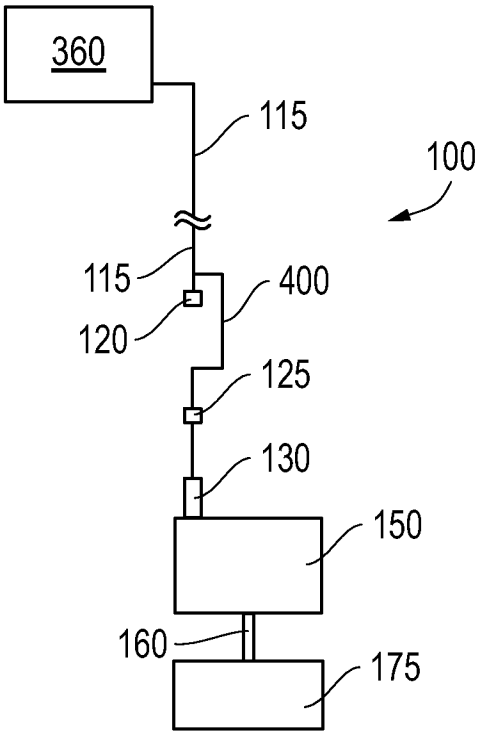
FIG. 4B is a schematic representation of the assembly of FIG. 4A with the packer set.
Figure 4A:
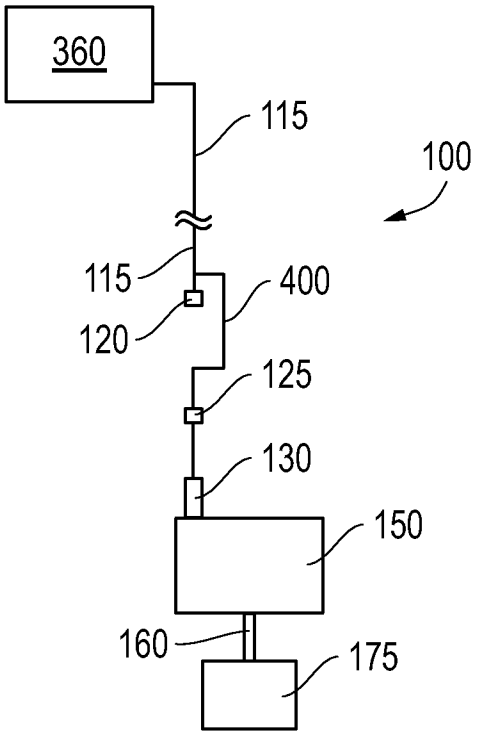
FIG. 4A is a schematic representation of the assembly of FIGS. 1-3 prior to setting of the packer.

Referring now to FIG. 4A, a schematic representation of the assembly 100 of FIG. 1 is depicted which is electrically coupled to the control unit 360 described above. That is, FIG. 4A reveals the electrical and hydraulic layout of the assembly 100 prior to setting of the packer 175. As described above, the assembly 100 includes an electrical line 115 which runs to the depicted gauge 120 as would often be the case for a conventional production packer assembly, for example. However, a line extension 400 is also provided so as to electrically couple the trigger 130 of the setting mechanism 150 to the electrical line 115, and ultimately the control unit 360 at surface.

The above noted line extension 400 may make up an additional 10 to 40 feet or so of wiring between a location near the gauge 120 and the trigger 130. Further, the coupling of the extension 400 to the line 115 may be configured as a feedthrough. In this manner, exposure by the trigger 130 or extension 400 to water and other downhole fluids should not carry over to such an exposure by the gauge 120. Thus, the reliability of readings obtained by the gauge 120 and detected at surface may be better ensured. Similarly, to prevent gauge readings from being affected by the setting mechanism 150, the noted fuse 125 is provided to eventually sever the extension 400 downhole of the gauge 120 as detailed below.

Referring now to FIG. 4B, a schematic representation of the assembly 100 is shown with the packer 175 of FIG. 4A radially expanding to a set state. That is to say, the trigger 130 of the setting mechanism 150 has been electrically actuated as directed by the control unit 360 over the electrical line 115 and extension 400. Thus, the setting mechanism 150 is activated to hydraulically set the packer 175 over the hydraulic line 160. Indeed, the packer 175 is graphically depicted as a bit larger in FIG. 4B as compared to FIG. 4A.

The above described trigger 130 may be of a conventional dump bailer or e-trigger variety. Additionally, actuation of the trigger 130 as described above may be achieved by reversing polarity over the line 115 so as to protect the gauge 120. Signal may then be sent over the line 115 and extension 400 to the trigger 130 for initiating of the setting application. Similarly, the end of setting may be detected over the line 115 and extension 400 thereby allowing for a return to standard operating polarity and monitoring relative the gauge 120.

Referring now to FIG. 4C, a schematic representation of the assembly 100 of FIG. 4B is depicted with the line extension 400 severed following setting of the packer 175. That is to say, the fuse 125 of FIGS. 4A and 4B has been set off and replaced by a break 450 in the extension 400. Thus, the possibility of communications between the setting mechanism 150 and its trigger 130 relative the gauge 120 is now eliminated. Furthermore, the gauge 120 may be located within a junction box for added isolation and protection from the fuse 125 and/or possible communications from the trigger 130 (or setting mechanism 150).

Figure 5:
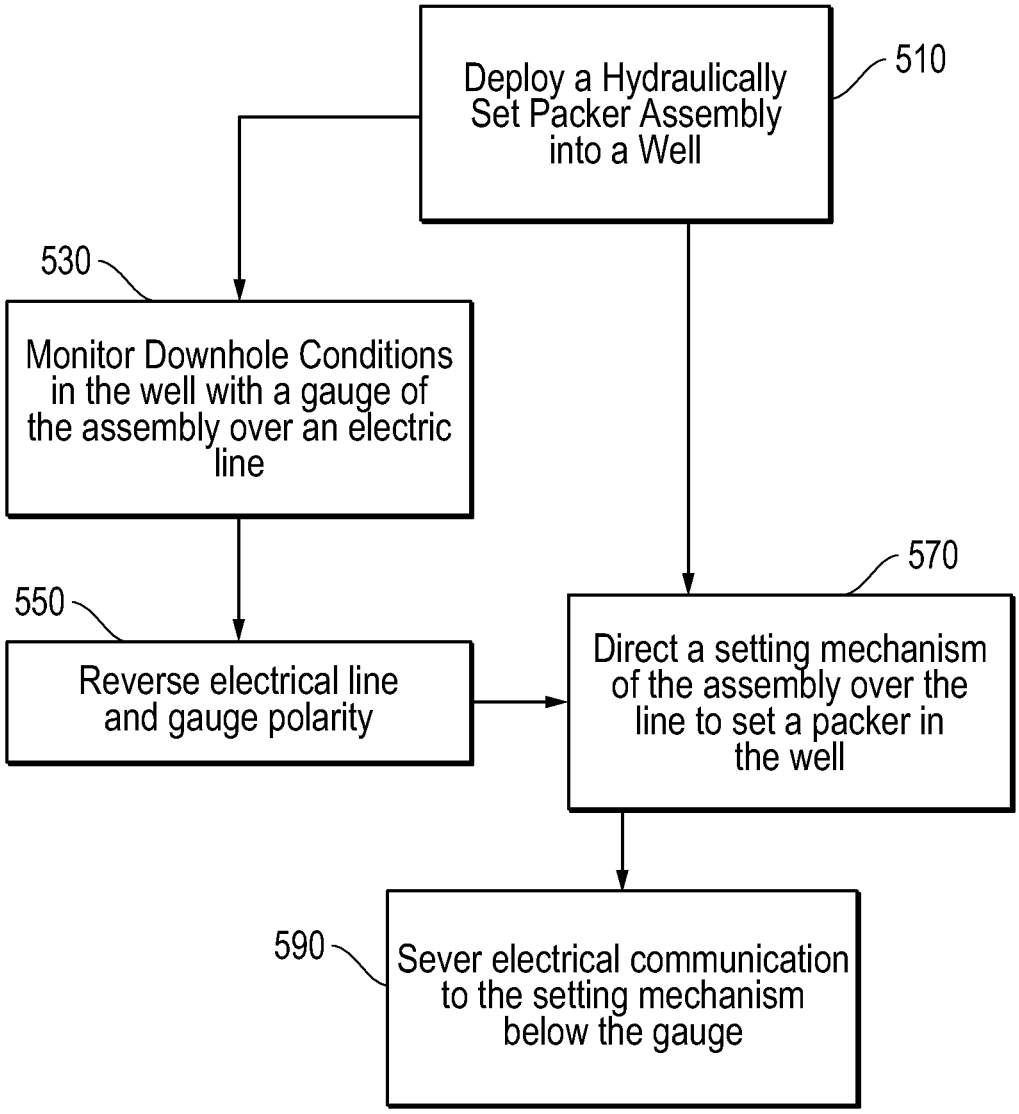
FIG. 5 is a flow-chart summarizing an embodiment of employing an electrically triggered pressure set packer assembly.

Referring now to FIG. 5, a flow-chart is depicted summarizing an embodiment of employing an electrically triggered pressure or hydraulically set, packer assembly. The assembly is deployed within a well as indicated at 510, for example, in conjunction with production tubing deployment as depicted at FIG. 3 herein. As with alternative conventional tubing deployments, downhole conditions such as pressure may be monitored with a gauge of the assembly. Data from such monitoring may be conveyed over an electric line running from the gauge to surface equipment at the oilfield accommodating the well (see 530).

Deployment of the assembly may also include setting of a packer, for example, to anchor and isolate production tubing, again as depicted in FIG. 3 herein. Indeed, as indicated at 570, the same line may be utilized in supporting communications to the setting mechanism of the assembly which is directed to achieve the packer setting. In one embodiment, the gauge is protected during the noted setting, by reversal of its polarity, along with that of the line, in advance of directing the setting application (see 550). By the same token, as indicated at 590, electrical communication to the setting mechanism may be severed below the gauge altogether once setting of the packer has been sufficiently attained.

Embodiments described hereinabove reduce the likelihood of having to remove and re-deploy an entire production string as a result of hydraulic strain induced on tubing due to packer setting. This is achieved in a manner that does not require the presence of a dedicated hydraulic line run from surface to the setting mechanism. Thus, concern over the introduction of new failure modes is eliminated. Furthermore, techniques for packer setting as detailed herein utilize an electric line that may already be in place as part of sensing equipment deployed with the production string at the outset of completions.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

We claim:

1. An electrically triggered pressure set packer assembly, the assembly comprising:

a packer disposed about a tubular;

a gauge secured to the tubular and in electrical communication with surface equipment over an electrical line;

a setting mechanism coupled to said packer and the line for electrical surface controlled triggering of setting of said packer; and a fuse for severing communication between said setting mechanism and the electrical line following the setting of said packer, wherein the electrical line remains in contact with the gauge even after the fuse is disabled.

2. The electrically triggered pressure set packer assembly of claim 1 wherein the tubular is production tubing.

3. The electrically triggered pressure set packer assembly of claim 2 further comprising extension tubing coupled to the production tubing and extending downhole of said packer.

4. The electrically triggered pressure set packer assembly of claim 1 wherein said packer is a mechanical completions packer.

5. The electrically triggered pressure set packer assembly of claim 1 wherein the gauge is a pressure gauge.

6. The electrically triggered pressure set packer assembly of claim 1 further comprising a line extension running from the electrical line adjacent said gauge, said setting mechanism coupled to the electrical line via said line extension.

7. The electrically triggered pressure set packer assembly of claim 6 wherein said line extension is of a feedthrough configuration.

8. The electrically triggered pressure set packer assembly of claim 6 wherein said setting mechanism comprises an electronic trigger for actuating the setting of said packer and for directly coupling to the electrical line.

9. An assembly disposed at an oilfield and comprising:

a hydraulic setting mechanism coupled to a packer about a tubular;

an electrical line coupled to a downhole gauge and in communication with said mechanism;

a control unit at a surface of the oilfield and coupled to said line for obtaining data from the downhole gauge and for directing a setting application through the mechanism; and a fuse in the electrical line downhole configured to be severed to prevent further communication between the control unit and the mechanism, wherein the electrical line remains in electrical communication with the downhole gauge even after the fuse is severed.

10. The assembly of claim 9 wherein said electrical line is a tubing encapsulated conductor.

11. A method of hydraulically setting a packer in a well, the method comprising:

deploying the packer into the well;

obtaining well data over an electric line from a gauge adjacent the packer;

directing a hydraulic setting application over the electric line to set the packer in the well; and severing surface communication with the setting mechanism and maintaining surface communication with the gauge following said directing.

12. The method of claim 11 further comprising reversing the polarity of the electric line and gauge during said directing.

13. The method of claim 11 wherein said directing comprises actuation of an electronic trigger of the setting mechanism for exposure thereof to well pressure.

14. The method of claim 13 wherein the setting mechanism is an intensifier.

* * * * *